US006152383A

United States Patent [19]

Chen

[11] Patent Number: 6,152,383

[45] Date of Patent: Nov. 28, 2000

[54] ULTRASONIC NEBULIZER

[75] Inventor: I-Cheng Chen, Taipei Hsien, Taiwan

[73] Assignee: King Ultrasonic Co., Ltd., Taipei Hsien, Taiwan

[21] Appl. No.: 09/444,510

[22] Filed: Nov. 22, 1999

[51] Int. Cl.[7] ..... B05B 1/08

[52] U.S. Cl. ..... 239/102.2; 239/338; 128/200.16

[58] Field of Search ..... 239/102.1, 102.2, 239/302, 337, 338; 128/200.14, 200.16

[56] References Cited

U.S. PATENT DOCUMENTS

| | | | |
|---|---|---|---|
| 3,901,443 | 8/1975 | Mitsui et al. | 239/338 X |
| 4,113,809 | 9/1978 | Abair et al. | 239/102.2 X |
| 4,976,259 | 12/1990 | Higson et al. | 239/102.2 X |
| 5,163,617 | 11/1992 | Clifford et al. | 239/338 X |
| 5,261,601 | 11/1993 | Ross et al. | 239/102.2 |
| 5,299,739 | 4/1994 | Takahashi et al. | 239/102.2 |

*Primary Examiner*—Andres Kashnikow
*Assistant Examiner*—Steven J. Ganey
*Attorney, Agent, or Firm*—Bacon & Thomas, PLLC

[57] ABSTRACT

An ultrasonic nebulizer for use in an inhaler, humidifier or mist maker, including a container holding a transmission medium, an ultrasonic vibrator having a sound wave generating area controlled by an electronic drive circuit to produce sound waves, and a tubular wave guide connected between the container and the ultrasonic vibrator to concentrate sound waves from the ultrasonic vibrator onto the transmission medium in the container, wherein the tubular wave guide has an inner diameter about the diameter of the sound wave generating area of the ultrasonic vibrator ±30%.

3 Claims, 9 Drawing Sheets

| Tube diameter | 1mm | 2mm | 3mm | 4mm | 5mm | 6mm | 7mm | 8mm | 9mm | 10mm | 11mm | 12mm | 13mm | 14mm | 15mm |
|---|---|---|---|---|---|---|---|---|---|---|---|---|---|---|---|
| 1st test | 0 | 0 | 0 | 0 | 0.02 | 0.2 | 0.38 | 0.44 | 0.54 | 0.44 | 0.12 | 0.12 | 0.1 | 0.08 | 0 |
| 2nd test | 0 | 0 | 0 | 0 | 0.05 | 0.2 | 0.3 | 0.5 | 0.48 | 0.44 | 0.14 | 0.08 | 0.1 | 0.1 | 0 |
| 3rd test | 0 | 0 | 0 | 0 | 0.04 | 0.16 | 0.3 | 0.5 | 0.6 | 0.42 | 0.1 | 0.1 | 0.1 | 0.1 | 0 |
| Average | 0 | 0.00 | 0.00 | 0.00 | 0.04 | 0.19 | 0.33 | 0.48 | 0.54 | 0.43 | 0.12 | 0.10 | 0.10 | 0.09 | 0.00 |

| Tube diameter | 1mm | 2mm | 3mm | 4mm | 5mm | 6mm | 7mm | 8mm | 9mm | 10mm | 11mm | 12mm | 13mm | 14mm | 15mm |
|---|---|---|---|---|---|---|---|---|---|---|---|---|---|---|---|
| 1st test | 0 | 0 | 0 | 0 | 0 | 0.1 | 0.2 | 0.326 | 0.46 | 0.56 | 0.616 | 0.31 | 0.12 | 0.1 | 0 |
| 2nd test | 0 | 0 | 0 | 0 | 0 | 0.11 | 0.2 | 0.3 | 0.46 | 0.5 | 0.6 | 0.32 | 0.11 | 0.1 | 0 |
| 3rd test | 0 | 0 | 0 | 0 | 0 | 0.09 | 0.22 | 0.36 | 0.42 | 0.6 | 0.61 | 0.3 | 0.12 | 0.1 | 0 |
| Average | 0 | 0.00 | 0.00 | 0.00 | 0.00 | 0.10 | 0.21 | 0.33 | 0.45 | 0.55 | 0.61 | 0.31 | 0.12 | 0.10 | 0.00 |

ULTRASONIC NEBULIZER

BACKGROUND OF THE INVENTION

The present invention relates to an ultrasonic nebulizer, and more particularly to such an ultrasonic nebulizer, which is practical for use in an inhaler, a humidifier, as well as a mist maker.

A regular ultrasonic nebulizer for use in an inhaler, humidifier or mist maker, is generally comprised of an ultrasonic vibrator controlled to produce sound field for making water or medicine into a mist. The sound field includes a far field area and a near field area. The border area between the far field area and the near field area is the sound wave energy concentrated area. However, because the sound wave is dispersed radially, it is not easy to effectively control the concentrated sound wave energy to break through the surface of the liquid. Improper control of the sound wave energy cannot evenly nebulize the liquid. U.S. Pat. No. 3,901,443 teaches a method of changing the sound wave emitting angle of an ultrasonic vibrator. According to U.S. Pat. No. 3,901,443, the sound wave emitting angle is set between 2°–22°. However, this method has its application limitation. For example, this method cannot eliminate refraction of sound waves in space, medicine cup, or partition means.

SUMMARY OF THE INVENTION

It is the main object of the present invention to provide an ultrasonic nebulizer, which is practical for use in an inhaler, a humidifier, as well as a mist maker. According to one aspect of the present invention, the ultrasonic nebulizer comprises a container holding a transmission medium, an ultrasonic vibrator having a sound wave generating area controlled by an electronic drive circuit to produce sound waves, and a tubular wave guide connected between the container and the ultrasonic vibrator to concentrate sound waves from the ultrasonic vibrator onto the transmission medium in the container. According to another aspect of the present invention, the tubular wave-guide is formed integral with the container. According to still another aspect of the present invention, through holes are provided for enabling the transmission medium to be circulated between the inner diameter of the tubular wave-guide and the holding chamber in the container. According to still another aspect of the present invention, the tubular wave-guide has a smooth inside wall for guiding the sound waves effectively.

DETAILED DESCRIPTION OF THE PREFERRED EMBODIMENT

Figure 1:
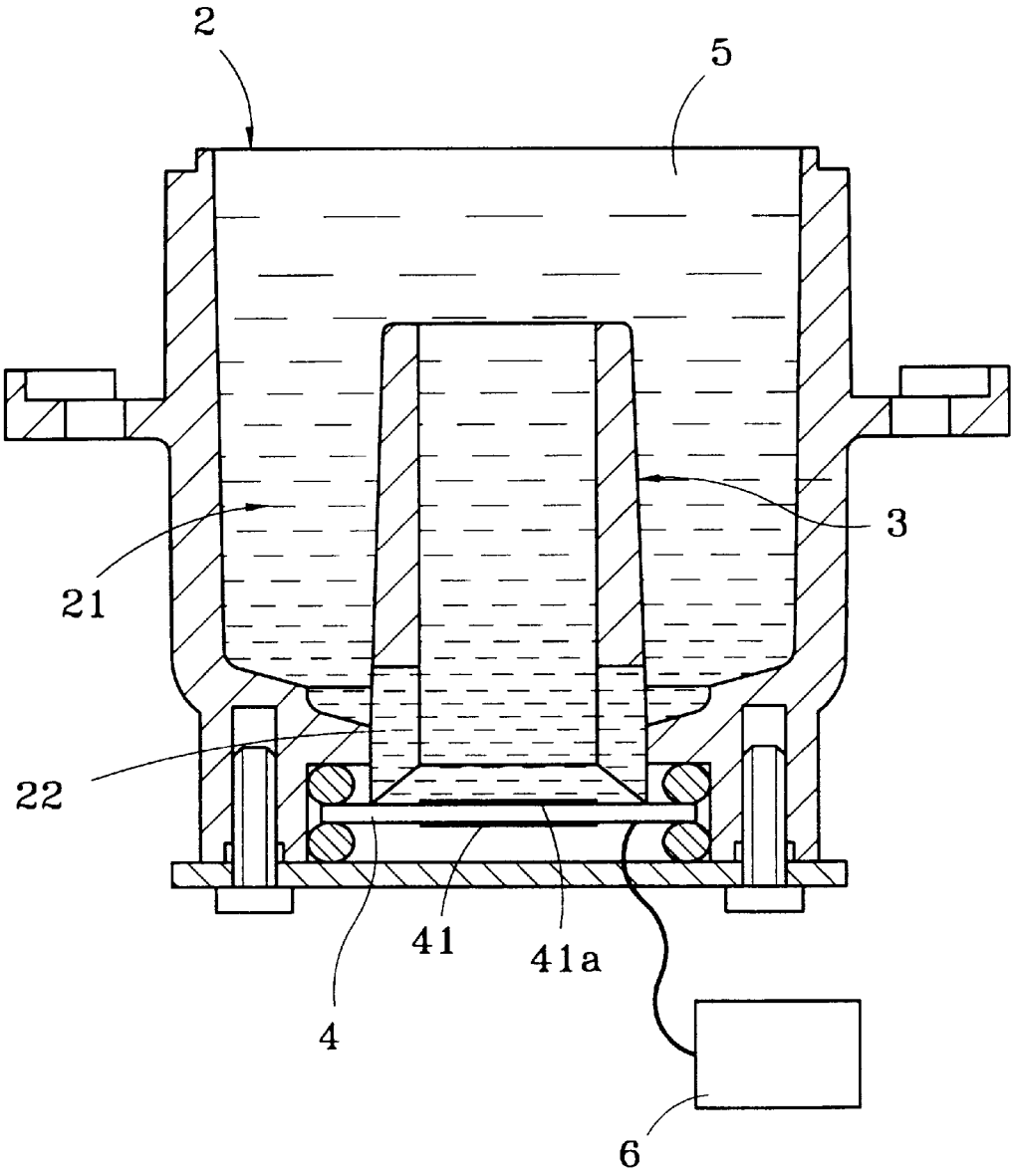
FIG. 1 is a sectional view showing the arrangement of the tubular wave-guide, the container, and the electronic drive circuit for an ultrasonic nebulizer according to the present invention.
Figure 7:
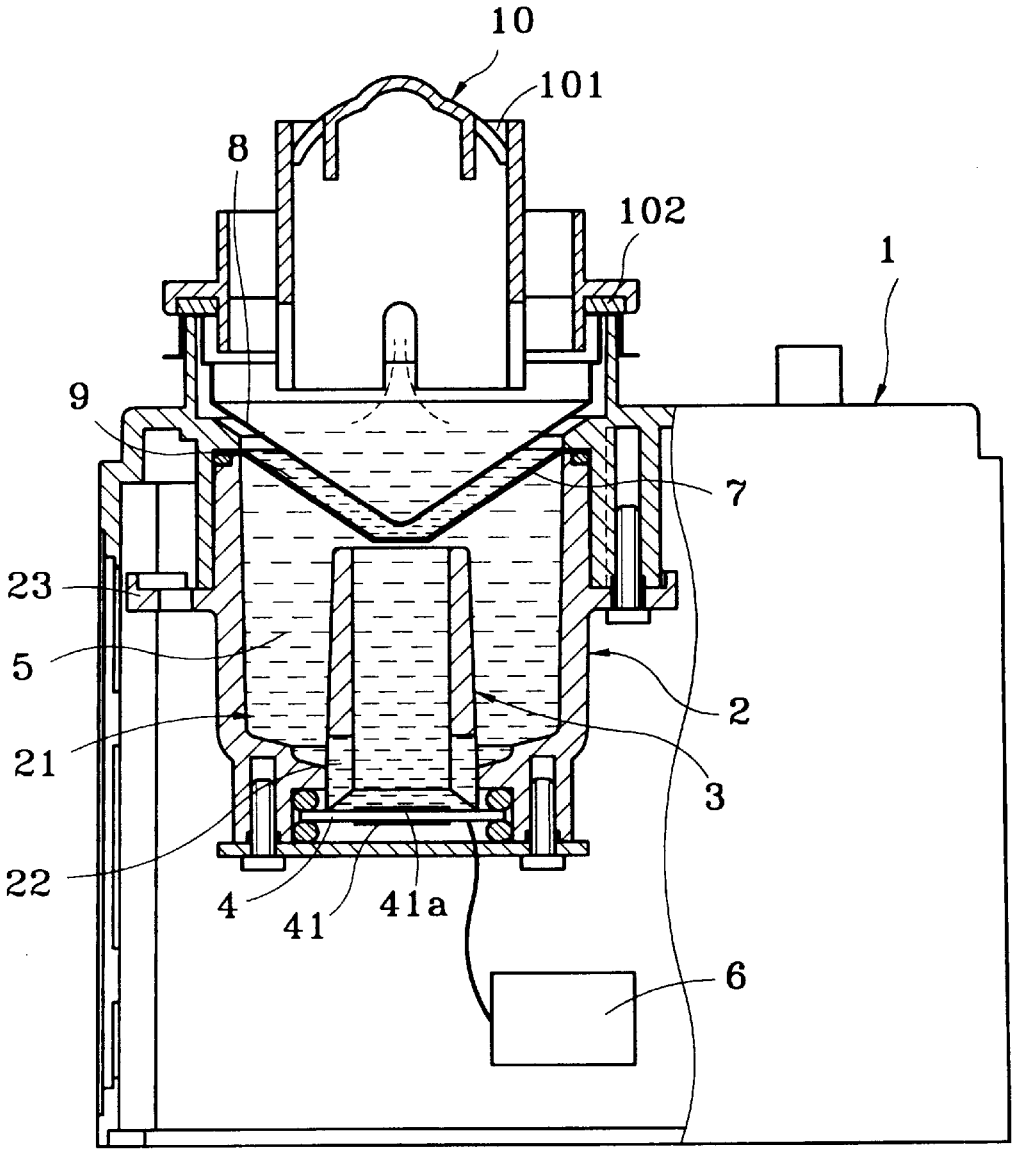
FIG. 7 is a side view in section showing the ultrasonic nebulizer installed in an inhaler according to the present invention.

Referring to FIGS. 1 and 7, the present invention comprises a housing 1, a container 2 mounted inside the housing 1, a tubular wave guide 3 disposed in the container 2, a transmission medium (water or any liquid) 5 carried in the holding chamber 21 defined within the container 2, an ultrasonic vibrator 4 disposed at the bottom side of the tubular wave guide 3, and an electronic drive circuit 6 connected to the ultrasonic vibrator 4 to control its operation. The tubular wave-guide 3 can be formed integral with the container 2, or separately made and then fixedly fastened to the container 2. The ultrasonic vibrator 4 comprises a sound wave generating area 41*a* facing the inner diameter of the tubular wave-guide 3 (the sound wave generating area 41*a* is equal to the polarized area 41, which is the silver layer area on the ultrasonic vibrator 4 that produces vibration when receiving an AC voltage). When the electronic drive circuit 6 is started to drive the ultrasonic vibrator 4, the sound wave generating area 41*a* is driven to produce a sound field. The sound waves from the sound field are guided to the transmission medium 5 by the tubular wave guide 3, causing sound waves to rush out through the surface tension of the transmission medium (water or any liquid) 5 in the holding chamber 21 of the container 2. Further, through holes 22 are disposed in communication between the tubular wave-guide 3 and the holding chamber 21 for circulation of the transmission medium 5 to improve nebulization efficiency.

Figure 2:
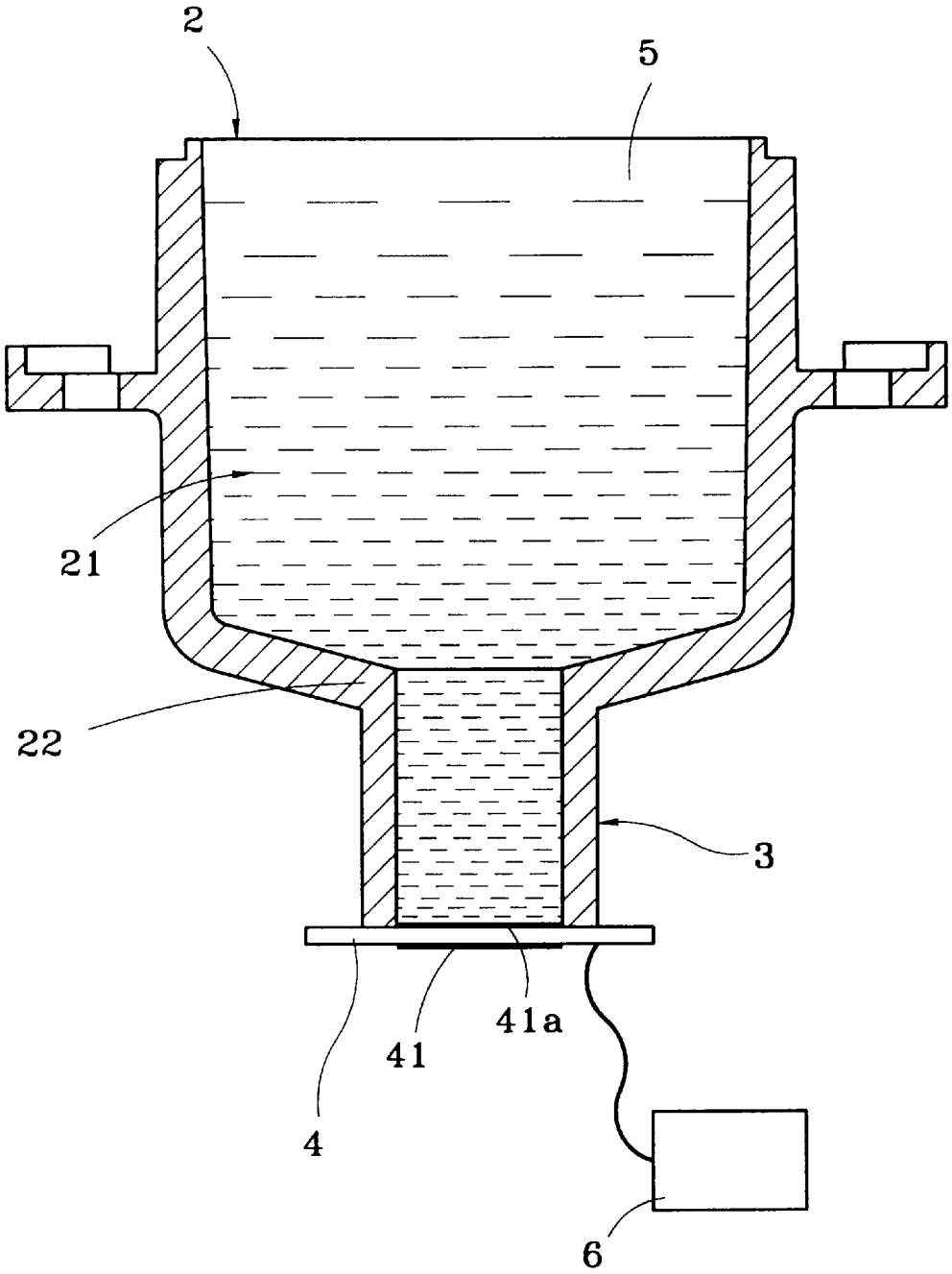
FIG. 2 is a sectional view showing an alternate form of the ultrasonic nebulizer according to the present invention.
Figure 3:
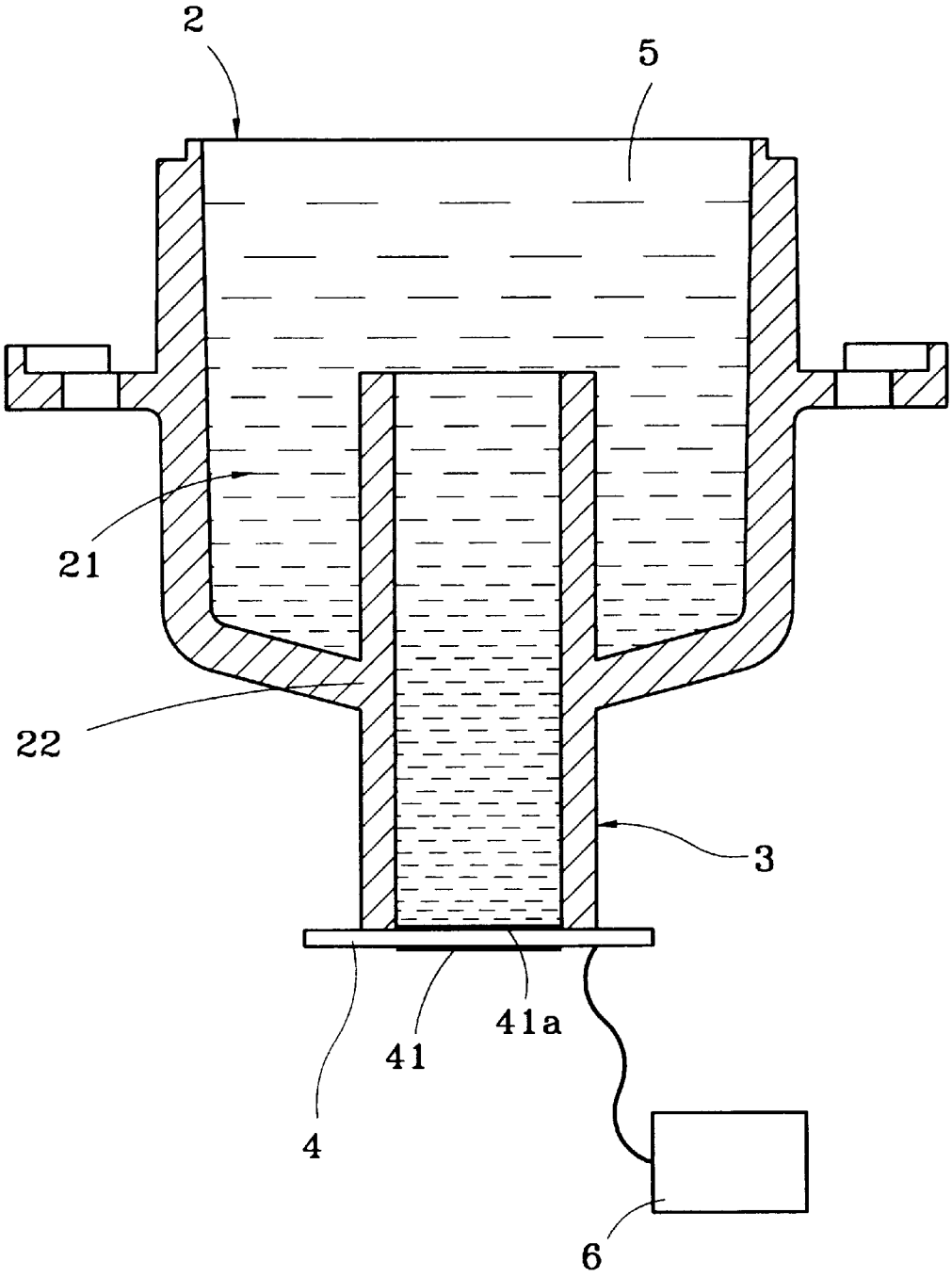
FIG. 3 is a sectional view showing another alternate form of the ultrasonic nebulizer according to the present invention

FIGS. 2 and 3 show different alternate forms of the present invention. According to these two alternate forms, the tubular wave-guide 3 protrudes over the bottom side of the container 2, and the ultrasonic vibrator 4 is mounted on the bottom end of the tubular wave-guide 3 with the sound wave generating area 41*a* disposed in contact with the transmission medium 5. When starting the electronic drive circuit 6, the sound wave generating area 41*a* is driven to produce a sound field, enabling sound waves to be guided by the tubular wave guide 3 to rush out through the surface tension of the transmission medium (water or any liquid) 5 in the holding chamber 21 of the container 2, and therefore transmission medium 5 is nebulized.

Figure 4:
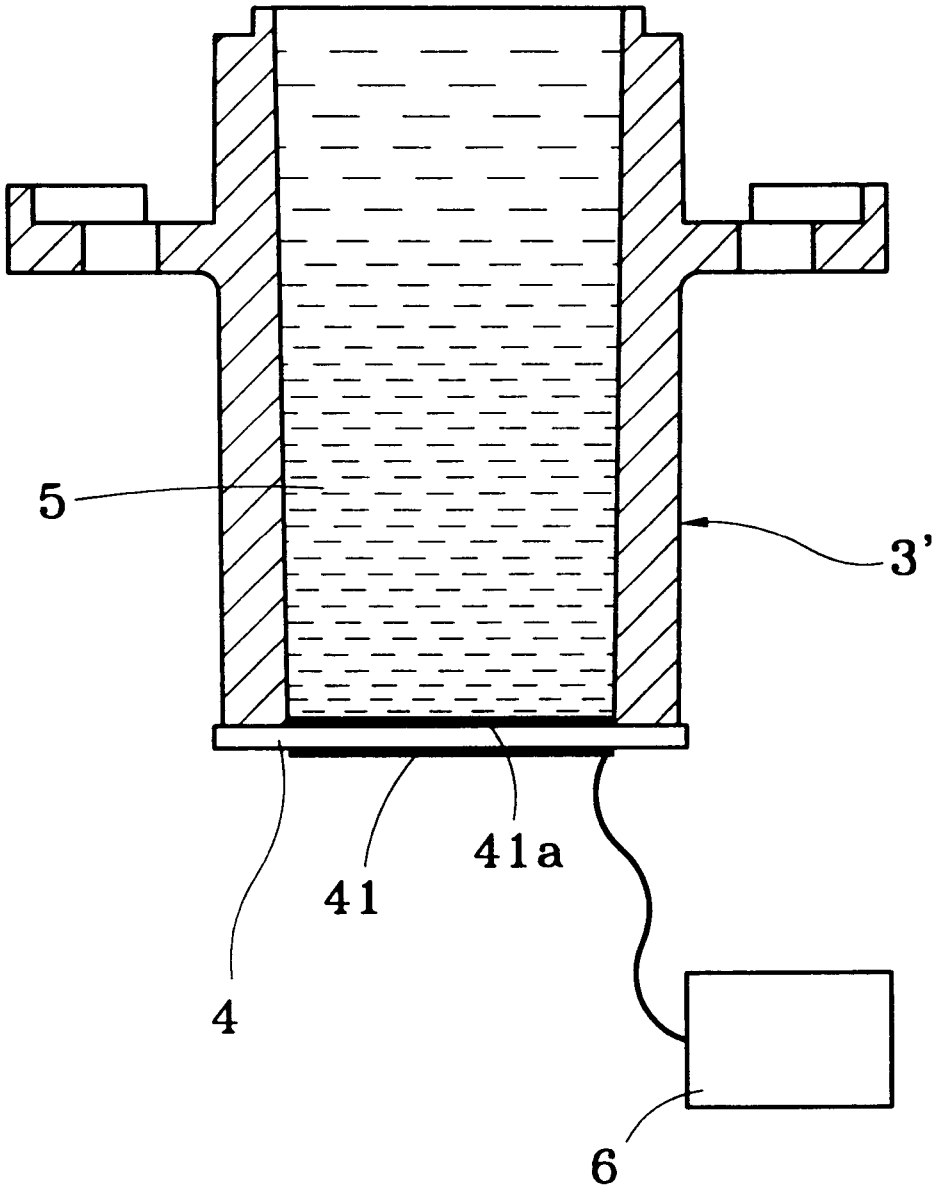
FIG. 4 is a sectional view showing still another alternate form of the ultrasonic nebulizer according to the present invention.

FIG. 4 shows still another alternate form of the present invention. According to this alternate form, the tubular wave guide 3' is formed integral with the container, and the ultrasonic vibrator 4 is mounted on the bottom end of the tubular wave guide 3' with the sound wave generating area 41*a* disposed in contact with the transmission medium 5. When starting the electronic drive circuit 6, the sound wave generating area 41*a* is driven to produce a sound field, enabling sound waves to be guided by the tubular wave guide 3 to rush out through the surface tension of the transmission medium (water or any liquid) 5 in the holding chamber 21 of the container 2, and therefore transmission medium 5 is nebulized.

As indicated above, the present invention uses a tubular wave guide 3 to concentrate and guide sound waves from an ultrasonic vibrator 4 to a transmission medium (water or any liquid) 5, causing the transmission medium to be nebulized into a mist.

Figure 8:
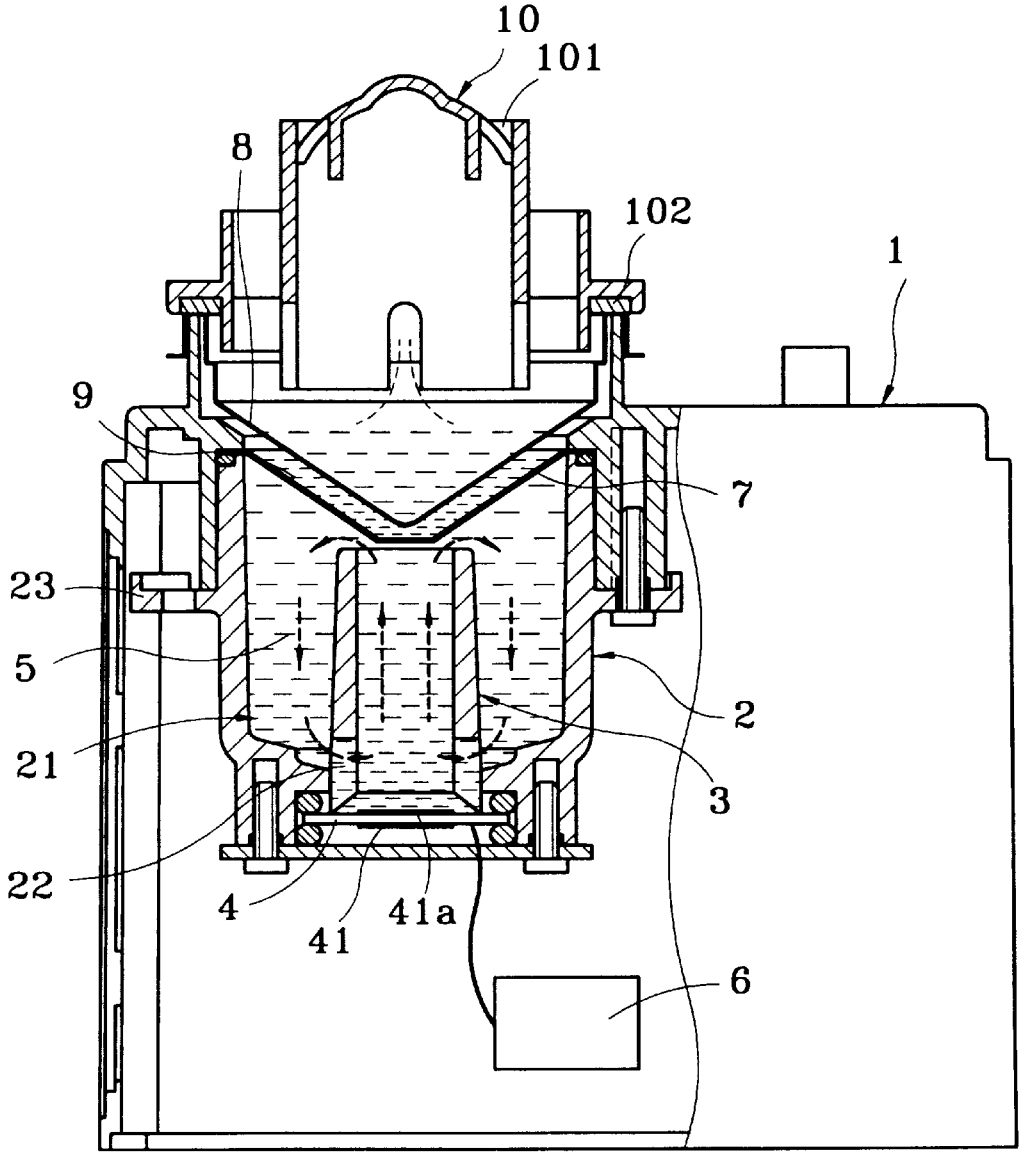
FIG. 8 is similar to FIG. 7 but showing the transmission medium circulated through the holes between the tubular wave-guide and the holding chamber of the container.

The inner diameter of the aforesaid tubular wave guide 3 is preferably about the diameter of the sound wave generating area 41*a* of the ultrasonic vibrator 4±30%, i.e., the inner diameter of the tubular wave guide 3 is determined subject to the sound wave generating area 41*a*. The relation between the inner diameter of the tubular wave guide and the ultrasonic vibrator is obtained from the test results shown in FIGS. 5 and 6 under the application of the apparatus shown in FIGS. 7 and 8. Test Apparatus for the test result shown in FIG. 5:

1. Ultrasonic vibrator:
   Diameter: 20 mm,
   Central frequency: 2.5 MHz
   Diameter of sound wave generating area: 9 mm.
2. Container:
   Inner diameter: 30 mm,
   Height between the surface of transmission medium and the surface of ultrasonic vibrator:
   26–36 mm
   Transmission medium: water
3. Tubular wave guide:
   Length: 20–22 mm.

apparatus shown in FIGS. 7 and 8.

Figure 5:
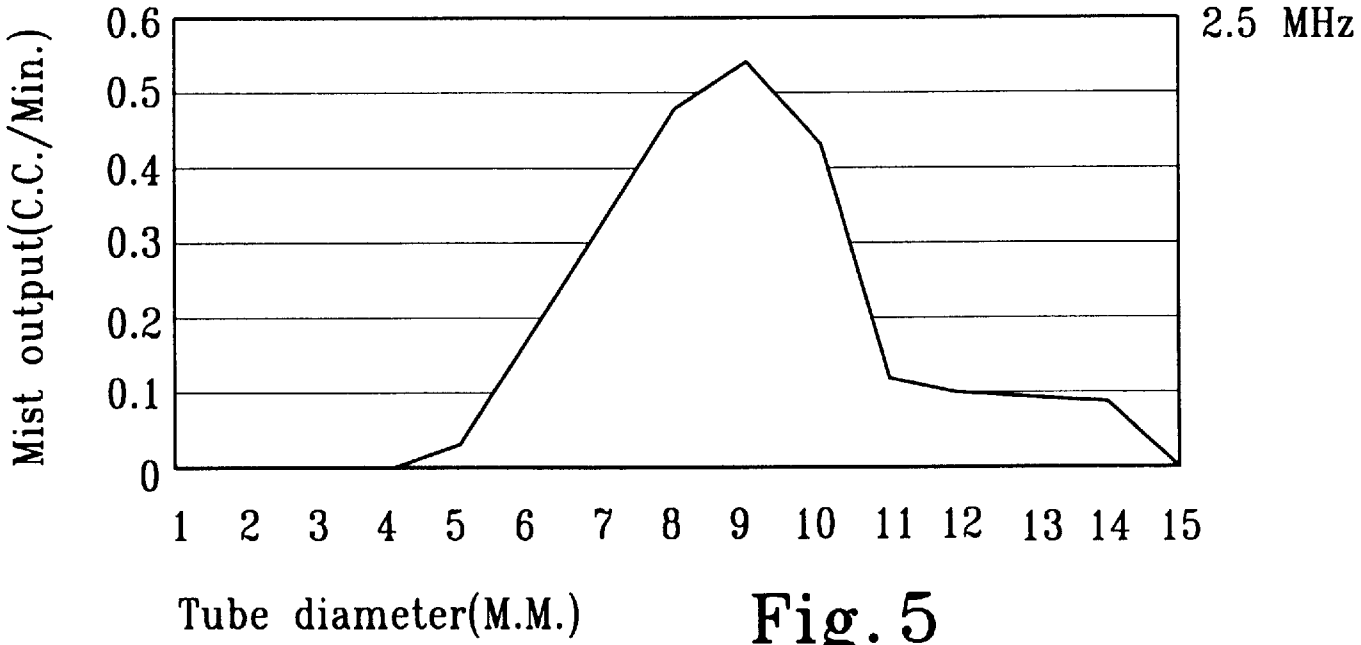
FIG. 5 is a tube diameter-mist output chart obtained from an ultrasonic nebulizer under frequency 2.5 MHz according to the present invention.

Test Apparatus for the test result shown in FIG. 5:

1. Ultrasonic vibrator:
   Diameter: 20 mm,
   Central frequency: 1.63 MHz
   Diameter of sound wave generating area: 11 mm.
2. Container:
   Inner diameter: 30 mm,
   Height between the surface of transmission medium and the surface of ultrasonic vibrator:
   26–36 mm
   Transmission medium: water
3. Tubular wave guide:
   Length: 20–22 mm.

Figure 6:
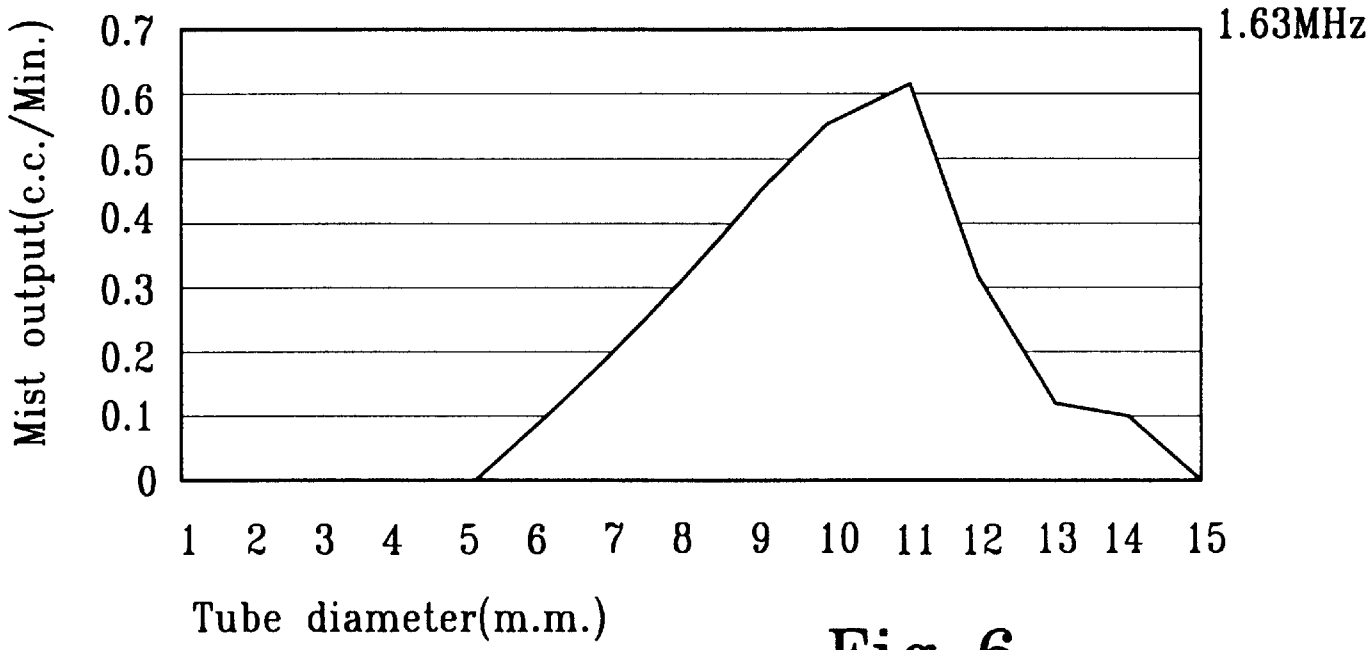
FIG. 6 is a tube diameter-mist output chart obtained from an ultrasonic nebulizer under frequency 1.63 MHz according to the present invention.

From the test results shown in FIGS. 5 and 6, the optimum nebulization effect is obtained under the condition that the inner diameter of the aforesaid tubular wave-guide 3 is about the diameter of the sound wave generating area 41*a* of the ultrasonic vibrator 4±30%. The nebulization effect becomes worse when the inner diameter of the tubular wave guide 3 is beyond the range of the diameter of the sound wave generating area 41*a* of the ultrasonic vibrator 4±30%, i.e., the wave concentrating and guiding performance of the tubular wave guide 3 drops when its inner diameter is beyond the e range of the diameter of the sound wave generating area 41*a* of the ultrasonic vibrator 4±30%. In order to transmit sound waves effectively, the inside wall of the tubular wave-guide 3 must be made smooth.

Referring to FIG. 7, when the ultrasonic nebulizer is used in an inhaler or humidifier, the mounting portion 23 of the container 2 is fastened to the inside wall of the housing 1, and a partition member 7 is disposed in the container 2 at the top side. The partition member 7 can have a V-shaped or U-shaped cross section. When starting the electronic drive circuit 6, the sound wave generating area 41*a* is driven to produce a sound field, enabling sound waves to be guided by the tubular wave-guide 3 to rush out through the surface tension of the liquid above the partition member 7, and therefore the liquid above the partition member 7 is nebulized. The partition member 7 can be fixedly fastened to the container 2. Alternatively, the partition member 7 can be a movable member attached to the container 2 at the topside.

When the ultrasonic nebulizer is used in an inhaler, a measuring instrument 8 is mounted on the topside of the partition member 7 to indicate the amount of medicine employed. Another transmission medium 9 is provided between the partition member 7 and the measuring instrument 8. When starting the electronic drive circuit 6, the sound wave generating area 41*a* is driven to produce a sound field, enabling sound waves to be guided by the tubular wave guide 3 to rush out through the surface tension of the medicine in the measuring instrument via the transmission medium 5 in the holding chamber 21 of the container 2 and the transmission medium 9 between the partition member 7 and the measuring instrument 8, and therefore the medicine is nebulized. Further, a hood 10 is covered on the measuring instrument 8, defining with the measuring instrument 8 a nebulization chamber. A gasket 102 is provided at the bottom side of the hood 10 to seal the gap between the hood 10 and the container 2. When nebulized, the mist of medicine passes out of through holes 101 on the hood 10 for inhalation by the patient.

FIG. 8 shows the circulation of the transmission medium 5. When sound waves are produced from the sound wave generating area 41*a*, the transmission medium is forced to circulate through the through holes 22 between the tubular wave guide 3 and the holding chamber 21.

Figure 9:
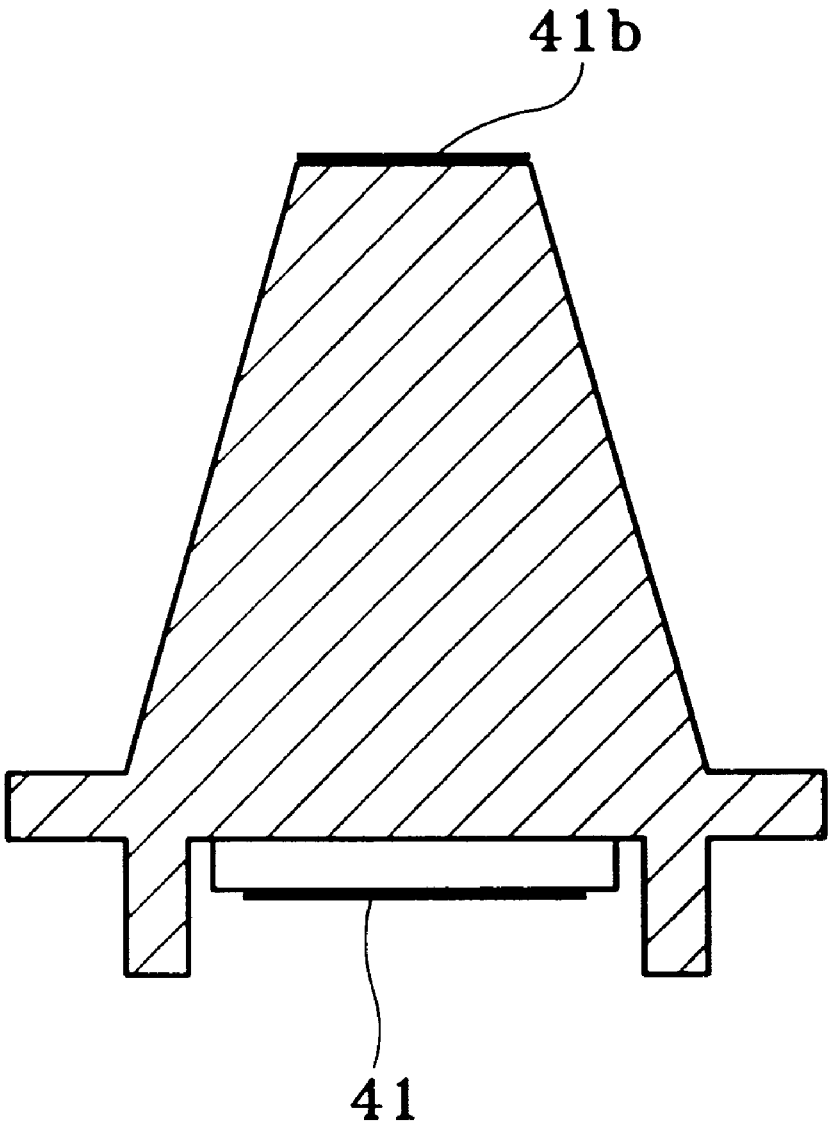
FIG. 9 is a sectional view showing an alternate form of the ultrasonic vibrator according to the present invention.

FIG. 9 shows an alternate form of the ultrasonic vibrator according to the present invention. According to this alternate form, the sound wave generating area 41*b* is fixedly mounted on a horn.

What the invention claimed is:

1. An ultrasonic nebulizer comprising a container holding a transmission medium, an ultrasonic vibrator having a sound wave generating area controlled by an electronic drive circuit to produce sound waves, and a tubular wave guide connected between said container and said ultrasonic vibrator to concentrate sound waves from said ultrasonic vibrator onto the transmission medium in said container, wherein said tubular wave guide has an inner diameter about the diameter of said sound wave generating area of said ultrasonic vibrator ±30%.

2. The ultrasonic nebulizer of claim 1 wherein said sound wave generating area is a polarized area.

3. The ultrasonic nebulizer of claim 1 wherein said tubular wave-guide is formed integral with said container.

* * * * *